United States Patent [19]

Kobayashi et al.

[11] Patent Number: 4,813,345

[45] Date of Patent: Mar. 21, 1989

[54] WIND DIRECTION DEFLECTION BLADE MOUNTING APPARATUS

[75] Inventors: Tatuhiro Kobayashi, Kusatsu; Yasuhiko Ebata, Otsu; Hideki Matsumi, Shiga; Seiji Fukui, Kusatsu; Koichi Ukai, Shiga, all of Japan

[73] Assignee: Matsushita Electric Industrial Co., Ltd., Osaka, Japan

[21] Appl. No.: 166,303

[22] Filed: Mar. 10, 1988

[30] Foreign Application Priority Data

Mar. 10, 1987 [JP] Japan ..... 62-54547

[51] Int. Cl.[4] ..... F25D 23/12

[52] U.S. Cl. ..... 98/94.2; 62/263; 74/42; 98/40.3

[58] Field of Search ..... 62/262, 263; 98/94.2, 98/121.2, 40.3; 74/42, 48, 50

[56] References Cited

U.S. PATENT DOCUMENTS 4,492,094 1/1985 Katayama ..... 62/262

4,676,146 6/1987 Takahashi et al. ..... 98/40.3

*Primary Examiner*—William E. Tapolcai

*Attorney, Agent, or Firm*—Wenderoth, Lind & Ponack

[57] ABSTRACT

A wind direction deflection blade mounting apparatus for use in a unitary air conditioner having an outer box, a substrate removably housed in the outer box, and a partition board which partitions said unitary air conditioner into an outdoor side and an internal side in which the outdoor side is provided with a compressor, a fan motor, an outdoor heat exchanger, and an indoor fan and said indoor side is provided with an indoor heat exchanger, an inlet port, and outlet port, and a foam including an indoor fan, which comprises a plurality of wind deflection blades, a coupling means for being rotatably coupled with said interlocking shafts of said blades, a motor housing chamber, a removable drive unit having a motor for reciprocating said coupling means housed in said motor housing chamber, a crankshaft extending from the shaft of said motor and a shaft inserting groove provided on the bottom face of said outlet port and opening in the front face thereof and extending toward the rear face of said outlet port thereby to render to easily assemble wind direction deflection blades mounted on an outlet port to make a pivotal motion.

6 Claims, 4 Drawing Sheets

WIND DIRECTION DEFLECTION BLADE MOUNTING APPARATUS

BACKGROUND OF THE INVENTION

1. Field of the Invention

The present invention relates to a wind direction deflection blade mounting apparatus of a unitary air conditioner.

2. Description of the Prior Art

The construction of a conventional unitary air conditioner of this type is as shown in FIGS. 5 through 7. Referring to FIGS. 5 through 7, the unitary air conditioner 1 comprises a substrate 2, a bulk head 5 provided on the substrate 2 and partitioning the unitary air conditioner 1 into an indoor ventilation path 3 and an outdoor ventilation path 4, and an outer box 6. The outdoor ventilation path 4 is provided with an outdoor heat exchanger 7 in the rear face thereof. A motor 8 is mounted on the rear face of the bulk head 5 so that its rotation shaft is disposed perpendicular to the rear face of the bulk head 5. A propeller fan 10 for blowing air toward the outdoor heat exchanger 7 is mounted on one end of the motor 8. A refrigerant cycle comprises a compressor 11 and the outdoor heat exchanger 7. The indoor vnetilation path 3 comprises a water pan (not shown) placed on the substrate 2, an air channel 12, and an indoor heat exchanger 18 mounted on the water pan and confronting an inlet grill 13. Air is introduced from the inlet grill 13 into the air channel 12 and blown out toward an outlet port 14 by a multibrade fan 9 mounted on the other end of the motor 8. The outlet port 14 comprises a lower plate 15 screwed to the bulk head, both-sides deflection blades 16 for deflecting air blown out of the air channel 12, a coupling member 17 interlocked with the both-sides deflection blade 16, and a motor 20 screwed to the lower plate 15 and coupled with the coupling member 17 through a shaft 19 extending from the motor 20.

A power supply portion 21 comprising an electric circuit for controlling the operation of the air conditioner and an electric circuit for controlling the operation of the motor 20 is mounted below the motor 20 connected to the power supply portion 21 through a wire.

The above-described construction has, however, disadvantages: The motor 20 and the power supply portion 21 are troublesome to assemble and disassemble because the motor 20 is mounted separately from the power supply portion 21, i.e., the motor 20 is mounted on the lower plate 15 of the outlet port 14 and the power supply portion 21 is mounted below the lower plate 15. Further, the replacement of the motor 20 requires the disassembly of the lower plate 15 of the outlet port 14. Furthermore, though the motor 20 is mounted rearwards on and removed frontwards from the lower plate 15, a troublesome work of raising, lowering, and turning it is required.

SUMMARY OF THE INVENTION

The present invention has been developed with a view to substantially solving the above-described disadvantages and has for its essential object to easily assemble wind direction deflection blades and replace a motor by providing means for mounting rearwards and removing frontwards the motor serving for allowing the wind direction deflection blades mounted on an outlet port to make a pivotal motion.

It is another object of the present invention to smoothly and reliably engage a crankshaft with a coupling member by forming a guide groove in an engaging portion of the coupling member.

It is still another object of the present invention to facilitate the replacement of the motor by holding the motor and electric circuits together as a unit.

It is a further object of the present invention to simplify the construction and reduce the number of parts by molding the coupling member with a synthetic resin and using an upper portion of a motor shaft as the crankshaft.

In accomplishing the above-described objects, according to the present invention, there is provided a wind direction deflection blade mounting apparatus for use in a unitary air conditioner having an outer box, a substrate removably housed in the outer box, and a partition board which partitions said unitary air conditioner into an outdoor side and an internal side in which the outdoor side is provided with a compressor, a fan motor, an outdoor heat exchanger, and an indoor fan and said indoor side is provided with an indoor heat exchanger, an inlet port, an outlet port, and a foam including an indoor fan comprising a plurality of wind deflection blades having openings provided on the top and bottom faces of said outlet port and spaced at a predetermined interval therebetween into which vertically extending shafts are rotatably inserted and interlocking shafts protruding in the same direction as that of said vertically extending shafts a coupling means for being rotatably coupled with said interlocking shafts of said wind direction deflection blades and for interlocking said wind direction deflection blades therewith a motor housing chamber positioned below the bottom face of said outlet port and opening in the front face thereof a removable drive unit having a motor for reciprocating said coupling means housed in said motor housing chamber a crankshaft extending upwards from the shaft extending from said motor and eccentric from said shaft extending from said motor and a shaft inserting groove provided on the bottom face of said outlet port and opening in the front face thereof and extending toward the rear face of said outlet port wherein said coupling means comprising an engaging portion opening in the front face thereof and extending toward the rear face of said oulet port and a connecting portion which extends laterally from a side of said engaging portion and has openings spaced at a predetermined interval and through which said interlocking shafts are rotatably inserted. In a preferred embodiment of the present invention, there is provided a wind direction deflection blade mounting apparatus for use in a unitary air conditioner as constructed as above, wherein said engaging portion of said coupling means is U-shaped, and said connecting portion extends from a side of said engaging portion, and said engaging portion is provided with a circular arc extending outwards from one end of said U-shaped engaging portion.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

Figure 1:
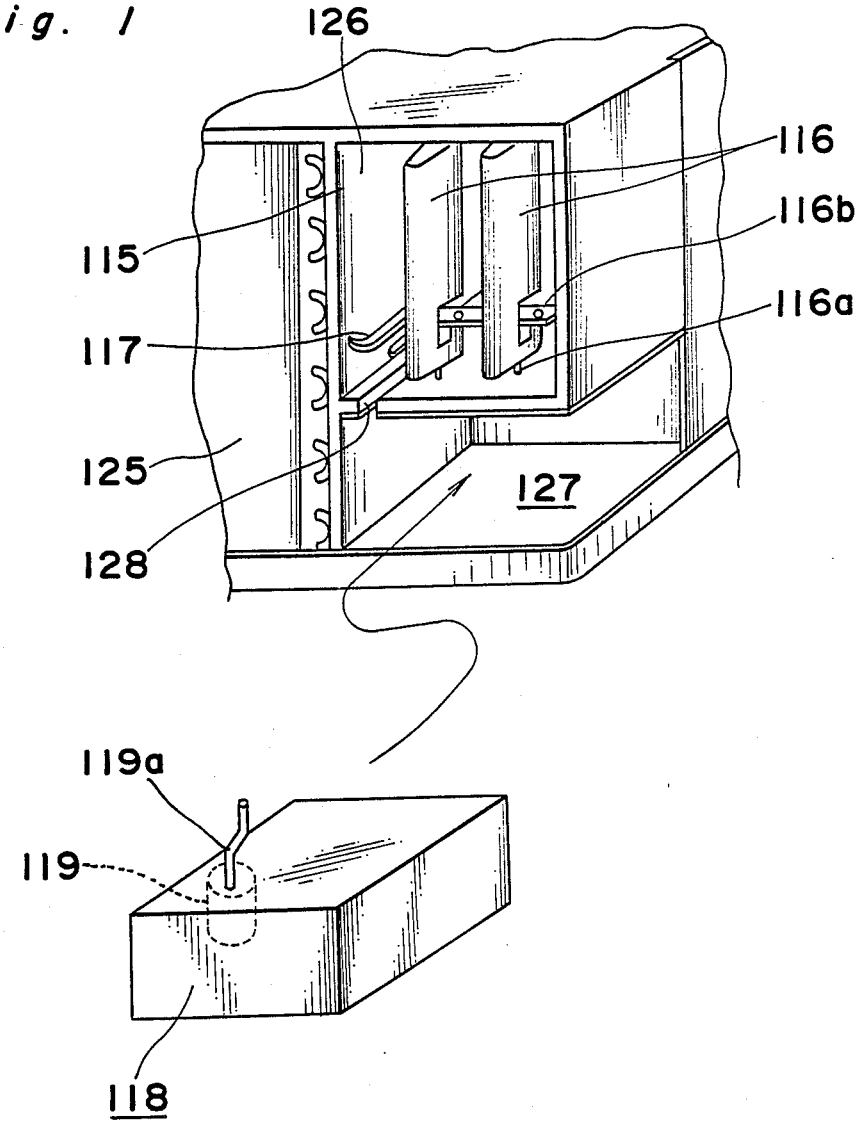
FIG. 1 is a perspective view of wind direction deflection appartus of an air conditioner showing an embodiment of the present invention.

Referring to FIGS. 1 through 4, an embodiment in accordance with the present invention is described.

An unitary air conditioner 101 comprises a front grill 102, an outer box 103, and internal units removably housed in the outer box 103. The front grill 102 removably mounted on the front face of the the unitary air conditioner 101 includes an inlet port 104, and outlet port 105, and an operation portion cover 106. The outer box 103 is formed of a cylindrical shape including a rear side plane, a right side elevational plane, a left side elevational plane, top plane and bottom plane of a body, and is provided with inlet louvers 107 on the top side thereof, and inlet louvers 108, and outlet louvers 109 adjacent to the inlet louvers 108 at both sides thereof, and an outlet port (not shown) covered with a guard net (not shown) on the rear side thereof.

The internal unit A comprises a substrate 110 and a bulk head 113 partitioning the unitary air conditioner into an indoor ventilation path 112 and an outdoor ventilation path 111.

The outdoor ventilation path 111 includes a compressor 120 constituting a refrigerant cycle, an outdoor heat exchanger 114, a fan motor 122 fixed to the bulk head 113 through a fixture 121 fixed to the bulk head 113 as well as the substrate 110, an outdoor fan 123 driven by the fan motor 122, and an air guide 124. The outdoor heat exchanger 114 is U-shaped so that it confronts the outlet port (not shown) mounted on the rear side of the outer box 103 and one of the outlet louvers 109 mounted on the sides of the outer box 103.

Figure 6:
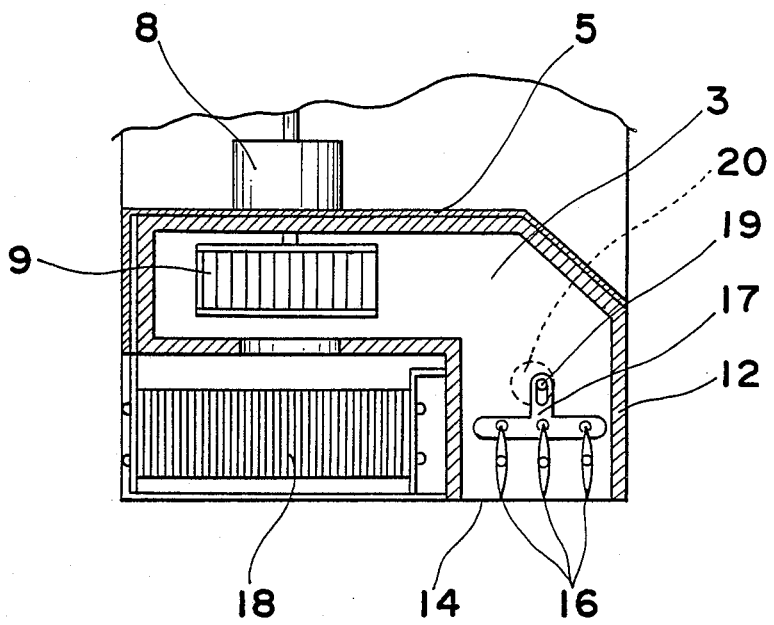
FIG. 6 is a sectional view of principal portions of the conventional air conditioner.
Figure 7:
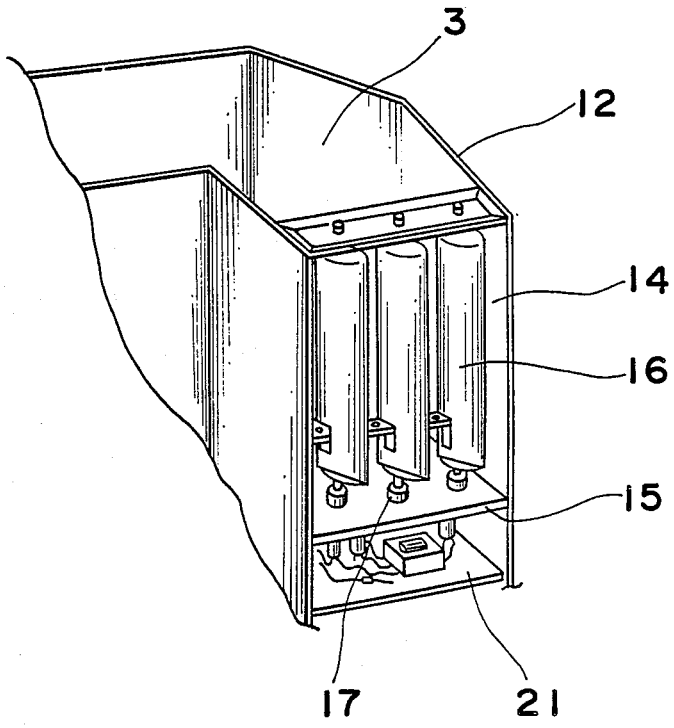
FIG. 7 is a perspective view showing the outlet port of the conventional air conditioner.

As with the construction shown in FIGS. 6 and 7, the indoor ventilation path 112 includes an air channel 115 communicating with the inlet port 104 and the outlet port 105, an indoor heat exchanger 125 confronting the inlet port 104, and a multiblade fan (not shown) to generate air flow from the inlet port 104 to the outlet port 105 through the indoor heat exchanger 125. The air channel 115 formed with an insulating material such as foam styrene is integrated with an outlet port 126 communicating with a water pan (not shown), a bell-mouth (not shown) for sending air to the multiblade fan, and an outlet port 126 communicating with the outlet port 105.

A reinforcing iron plate 129 is screwed to the underside of the bulk head 113 and a motor housing portion 127 whose front face and one side open is disposed below the outlet port 126. The motor housing portion 127 will be described later.

The top and bottom faces of the outlet port 126 are provided with a pair of openings, respectively into which shafts **116*a* mounted on the upper and lower ends of the wind direction deflection blades 116 for deflecting air passing the outlet port 126 are rotatably inserted. A shaft inserting groove 128 is formed on the bottom face of the outlet port 126 so that a crankshaft 119*a* may be inserted into the coupling member 117**.

The wind direction deflection blade 116 is provided with interlocking shafts **116*b* with which the coupling member 117 for allowing a pivotal motion of the wind direction deflection blades 116** in a wind direction is coupled.

Figure 2:
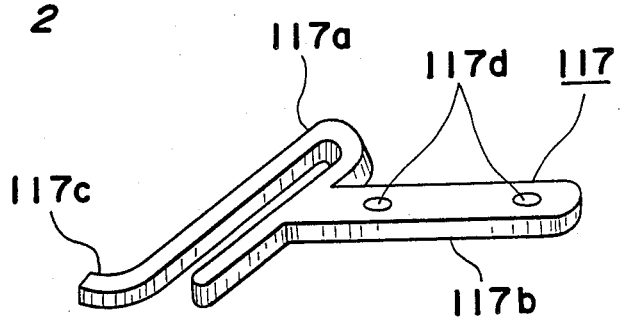
FIG. 2 is a perspective view of a coupling member of the wind direction deflection appartus.
Figure 3:
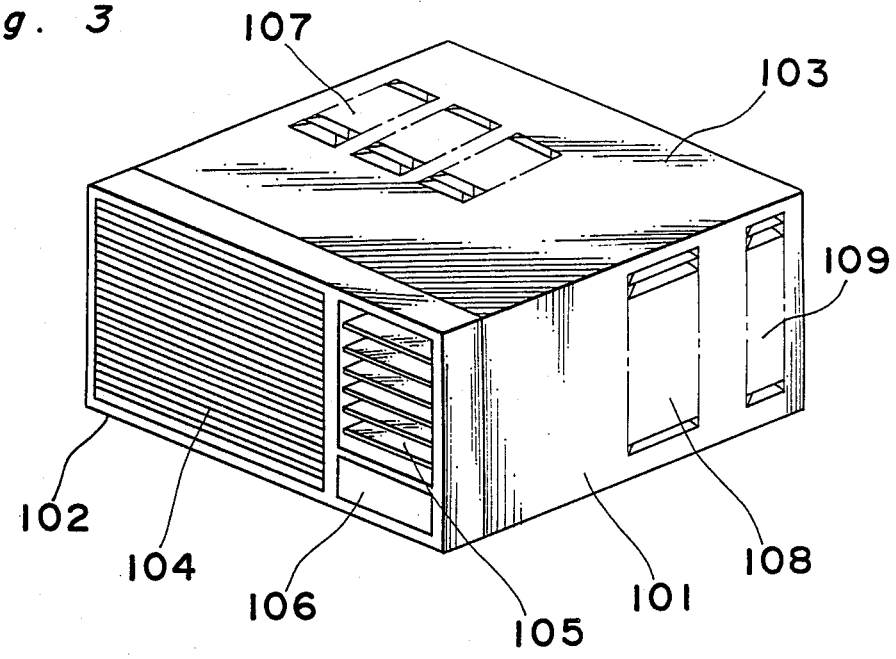
FIG. 3 is a perspective view of the air conditioner.
Figure 4:
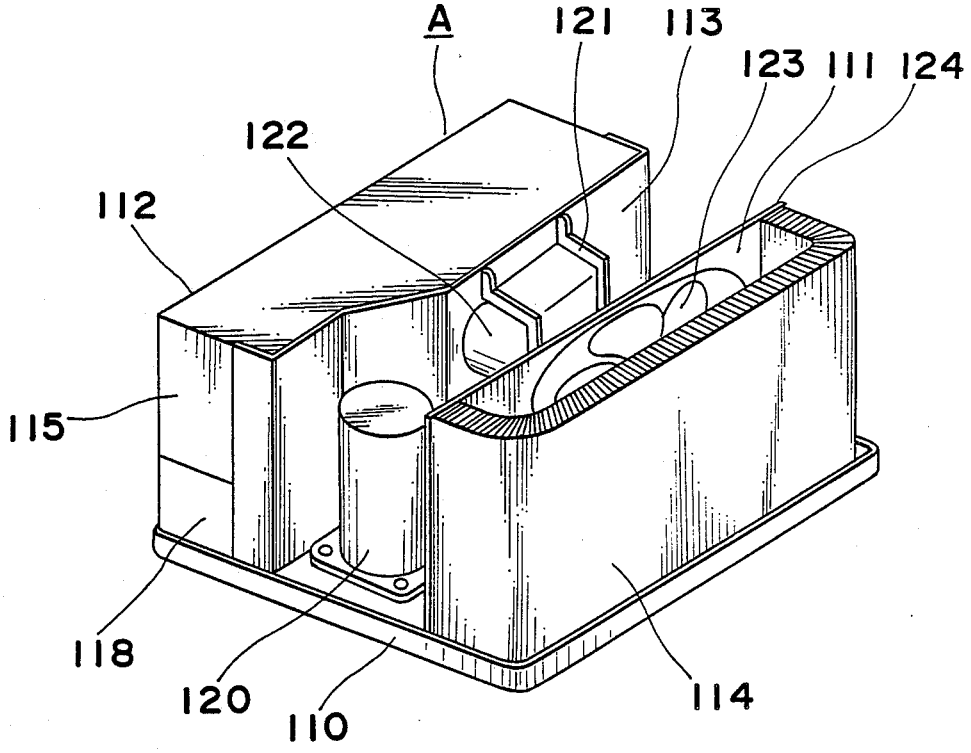
FIG. 4 shows internal units of the air conditioner.
Figure 5:
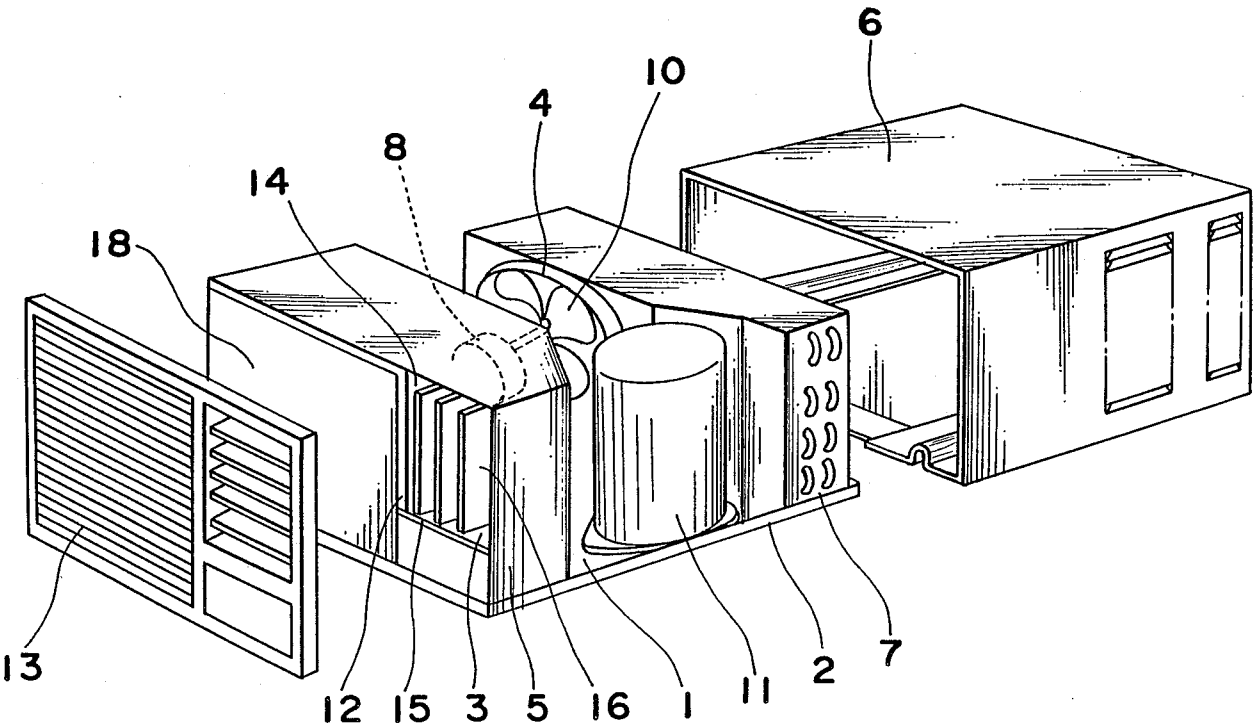
FIG. 5 is a perspective view showing a conventional air conditioner.

Referring to FIG. 2, the coupling member 117 comprises a U-shaped engaging portion **117*a* and a connecting portion 117*b* extending from the engaging portion 117*a*. One end of the engaging portion 117*a* extends outward to form a circular arc guide 117*c*. The connecting portion 117*b* is provided with openings 117*d* with which the shafts 116*b* of the wind direction deflection blades 116 rotatably engage. A relatively stiff synthetic resin such as polyacetal is molded to form the coupling member 117**.

A power supply unit 118 to be housed in the motor housing portion 127 incorporates, as one unit, a motor 119 for allowing the pivotal motion of the wind direction deflection blades 116, an electric circuit for controlling the motor 119, and an electric circuit for controlling the operation of the air conditioner. The power supply unit 118 is screwed to the bulk head 113 and other members.

The shaft **119*a* extending from the motor 119** is bent in the shape of a letter "L" from its middle portion to form a crankshaft.

The shaft **119*a* of the motor 119 is coupled with the coupling member 117 when the power supply unit 118 is housed in the motor housing portion 127**.

The power supply unit 118 is housed in the motor housing portion 127 with the crankshaft **119*a* of the motor 119 inserted into the shaft inserting groove 128. If the engaging portion 117*a* of the coupling member 117 is displaced laterally with respect to the shaft inserting groove 128, the contact of the shaft 119*a* and the guide 117*c* corrects the displacement of the coupling member 117. As a result, the crankshaft 119*a* engages with the guide 117*c*** in place.

Thus, the operation to house the power supply unit 118 in the motor housing portion is just to move it along the shaft inserting groove without turning it. Further, since the motor 119 and the power supply portion are held together as a unit, the motor 119 can be replaced by only removing the power supply unit 118 from the motor housing portion 127.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A wind direction deflection blade mounting apparatus for use in a unitary air conditioner having an outer box, a substrate removably housed in the outer box, and a partition board which partitions said unitary air conditioner into an outdoor side and an indoor side in which the outdoor side is provided with a compressor, a fan motor, an outdoor heat exchanger, and an outdoor fan and said indoor side is provided with an indoor heat exchanger, an inlet port, an outlet port, and an air channel connecting said ports and including an indoor fan, said apparatus comprising:

aid outlet port haivng openings provided on the top and bottom faces thereof and spaced at a predetermined interval therebetween vertically extending shafts which are rotatably inserted into said openings and interlocking shafts protruding in the same direction as that of said vertically extending shafts;

a coupling means for being rotatably coupled with said interlocking shafts of said wind direction deflection blades and for interlocking said wind direction deflectoin blades therewith;

a motor housing chamber positioned below the bottom face of said outlet port and opening in the front face thereof;

a removable drive unit having a motor for reciprocating said coupling means housed in said motor housing chamber;

a crankshaft extending upwards from the shaft extending from said motor and eccentric from said shaft extending from said motor; and a shaft inserting groove provided on the bottom face of said oulet port and opening in the front face thereof and extending toward the rear face of said outlet port;

said coupling means comprising an engaging portion opening in the front face of said outlet port and extending toward the rear face of said oulet port and a connecting portion which extends laterally from a side of said engaging portion and has openings spaced at a predetermined interval and through which said interlocking shafts are rotatably inserted.

2. A wind direction deflection blade mounting apparatus for use in a sanitary air conditioner as claimed in claim 1, wherein said engaging portion of said coupling means is U-shaped, and said connecting portion extends from a side of said engaging portion, and said engaging portion is provided with a circular arc extending outwards from one end of said U-shaped engaging portion.

3. A wind direction deflection blade mounting apparatus for use in a unitary air conditioner as claimed in claim 2, wherein said coupling means consists of a synthetic resin.

4. A wind direction deflection blade mounting apparatus for use in a unitary air conditioner as claimed in claim 2, wherein said drive unit comprises a motor and an electric circuit for controlling the unitary air conditioner.

5. A wind direction deflection blade mounting apparatus for use in a unitary air conditioner as claimed in claim 3, wherein said drive unit comprises a motor and an electric circuit for controlling the unitary air conditioner.

6. A wind direction deflection blade mounting apparatus for use in a unitary air conditioner having an outer box, a substrate removably housed in the outer box, and a partition board which partitions the air conditioner into an outdoor side and an indoor side in which the outdoor side is provided with a compressor, a fan motor, an outdoor heat exchanger, and an outdoor fan and said indoor side is provided with an indoor heat exchanger, an inlet port, an outlet port, and an air channel connecting said ports and including an indoor fan, said apparatus comprising:

a reinforcing plate provided at the lower face of said outlet port;

said outlet port having openings provided on the top and bottom faces thereof and spaced at a predetermined interval therebetween and a plurality of wind deflection blades having vertically extending shafts which are rotatably inserted into said openings and interlocking shafts protruding in the same direction as that of said vertically extending shafts;

a synthetic resin-consisting coupling means for being rotatably coupled with said interlocking shafts of said wind direction blades and for interlocking said wind direction deflection blades therewith;

a motor housing chamber located at the bottom portion of said outlet port and opening in the front face thereof;

a removable drive unit having a motor for reciprocating said coupling means and an electric circuit for controlling the operation of the unitary air conditioner housed in said motor housing chamber;

a crankshaft bent from a substantially middle of the shaft extending from said motor and eccentric from said shaft extending from said motor; and a shaft inserting groove which is provided on the bottom face of said outlet port and whose front face opens and which extends toward the rear face of said outlet port through which said crankshaft of said motor is inserted;

said coupling means comprising an approximately U-shaped engaging portion opening in the front face of said outlet port and extending toward the rear face of said outlet port, and a connecting portion which extends laterally from a side of said engaging portion and has openings spaced at a predetermined interval therebetween and through which said interlocking shafts are rotatably inserted, and a circular arc extending outwards from an end of said U-shaped engaging portion.

* * * * *